US005215109A

United States Patent [19]

Kent, Jr.

[11] Patent Number: 5,215,109

[45] Date of Patent: Jun. 1, 1993

[54] WEATHER SHELTER

[76] Inventor: John E. Kent, Jr., 900 Siskiyou Blvd., No. A-3, Medford, Oreg. 97501

[21] Appl. No.: 873,388

[22] Filed: Apr. 24, 1992

[51] Int. Cl.[5] ..... E04H 15/36

[52] U.S. Cl. ..... 135/102; 135/104; 135/118; 135/105

[58] Field of Search ..... 135/102, 105, 104, 116, 135/109, 900-902, 118

[56] References Cited

U.S. PATENT DOCUMENTS

| | | | |
|---|---|---|---|
| 2,142,851 | 1/1939 | Jolly . | |
| 2,167,219 | 7/1939 | Sankey | 135/102 |
| 2,299,078 | 10/1942 | Craig et al. | 135/115 |
| 2,689,579 | 9/1954 | Sartori . | |
| 2,829,660 | 4/1958 | Wester et al. . | |
| 2,832,361 | 4/1958 | Smith . | |
| 2,923,547 | 2/1960 | Heeremans | 135/102 X |
| 2,932,833 | 4/1960 | Wambach | 135/102 X |
| 2,969,075 | 1/1961 | Girten . | |
| 3,255,467 | 6/1966 | Kowalski | 135/102 X |
| 3,386,456 | 6/1968 | Walker | 135/102 |
| 3,856,029 | 12/1974 | Huddle | 135/102 |
| 4,106,145 | 8/1978 | Gillen et al. | 135/901 X |
| 4,440,187 | 4/1984 | Fiddler . | |
| 4,646,770 | 3/1987 | Lobato | 135/102 |
| 4,683,900 | 8/1987 | Carmichael . | |
| 4,719,934 | 1/1988 | Mydans | 135/102 X |
| 4,739,784 | 4/1988 | Fast | 135/104 X |
| 4,915,120 | 4/1990 | Ziolkowski . | |

*Primary Examiner*—Richard E. Chilcot, Jr.
*Assistant Examiner*—Lan M. Mai
*Attorney, Agent, or Firm*—Kolisch, Hartwell, Dickinson, McCormack & Heuser

[57] ABSTRACT

A weather shelter adapted for multi-positional placement adjacent a reference structure wherein the shelter includes a framework, a flexible cover and an anchor assembly for uniting the framework and the reference structure in a plurality of relative orientations. The framework includes a pair of spaced bows, each terminating oppositely in first and second terminal ends at which such bows are operatively combined. The anchor assembly is selectively securable to the framework at one of a plurality of securement locations.

18 Claims, 2 Drawing Sheets

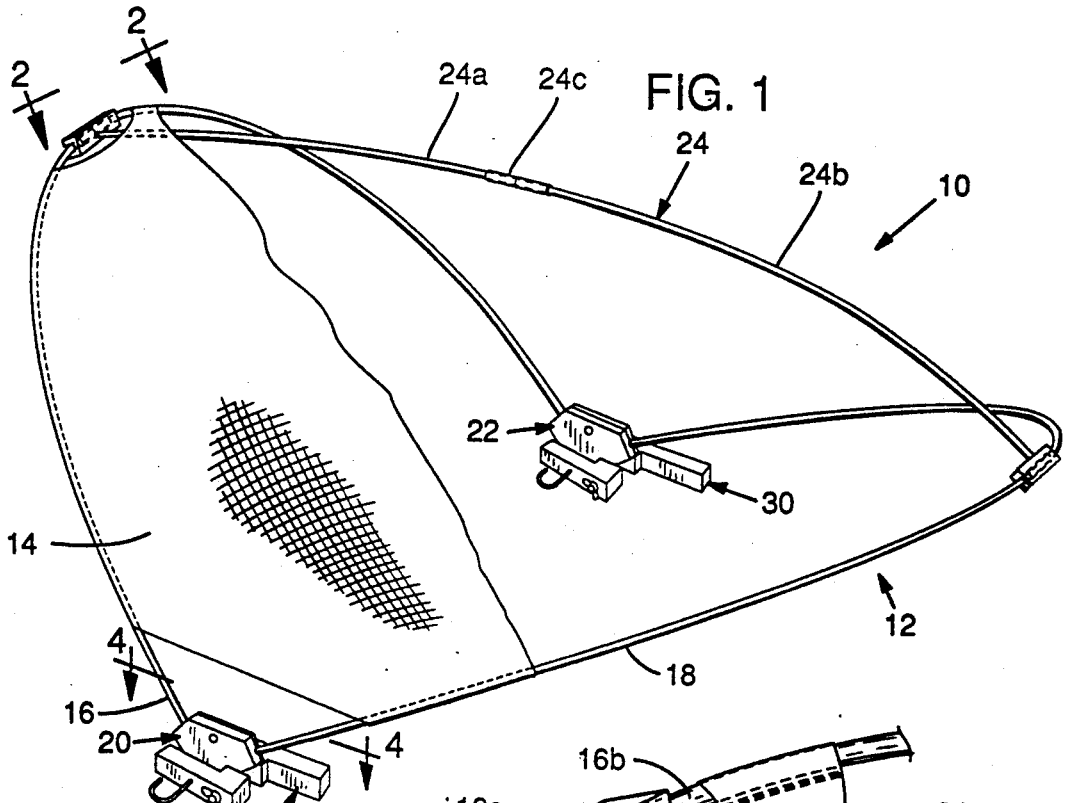
FIG. 1
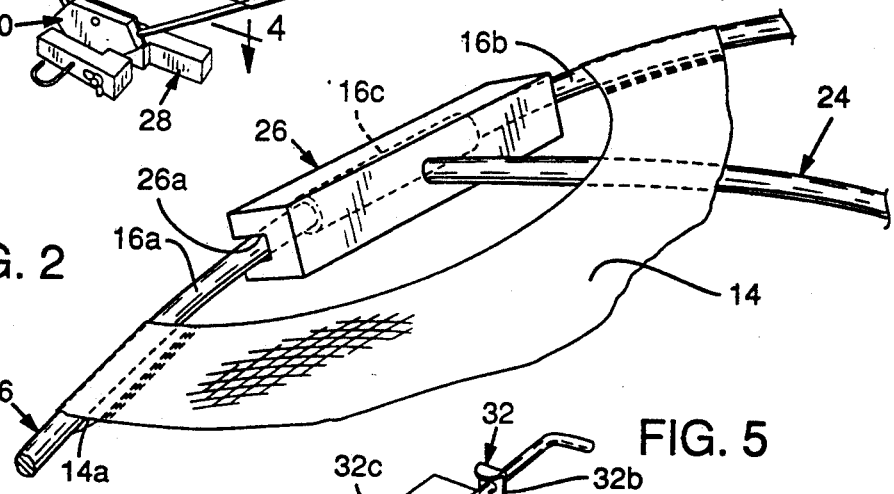
FIG. 2
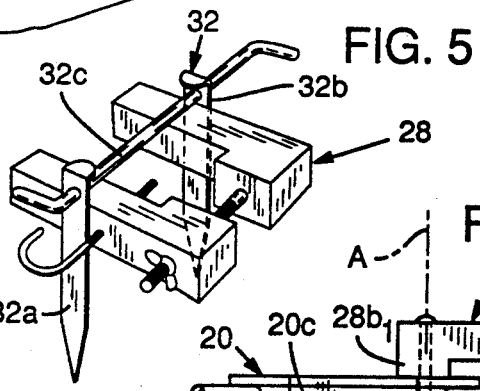
FIG. 5
FIG. 3
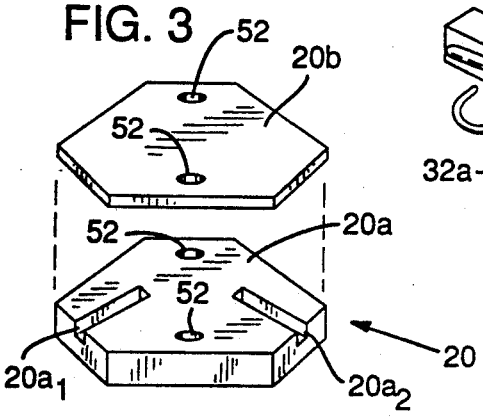
FIG. 4
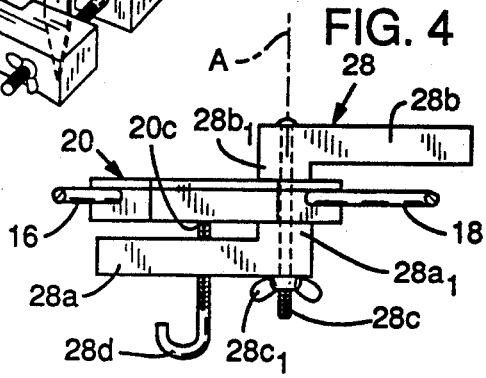

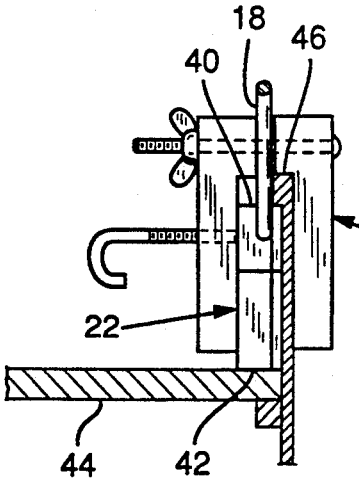
FIG. 8
FIG. 6
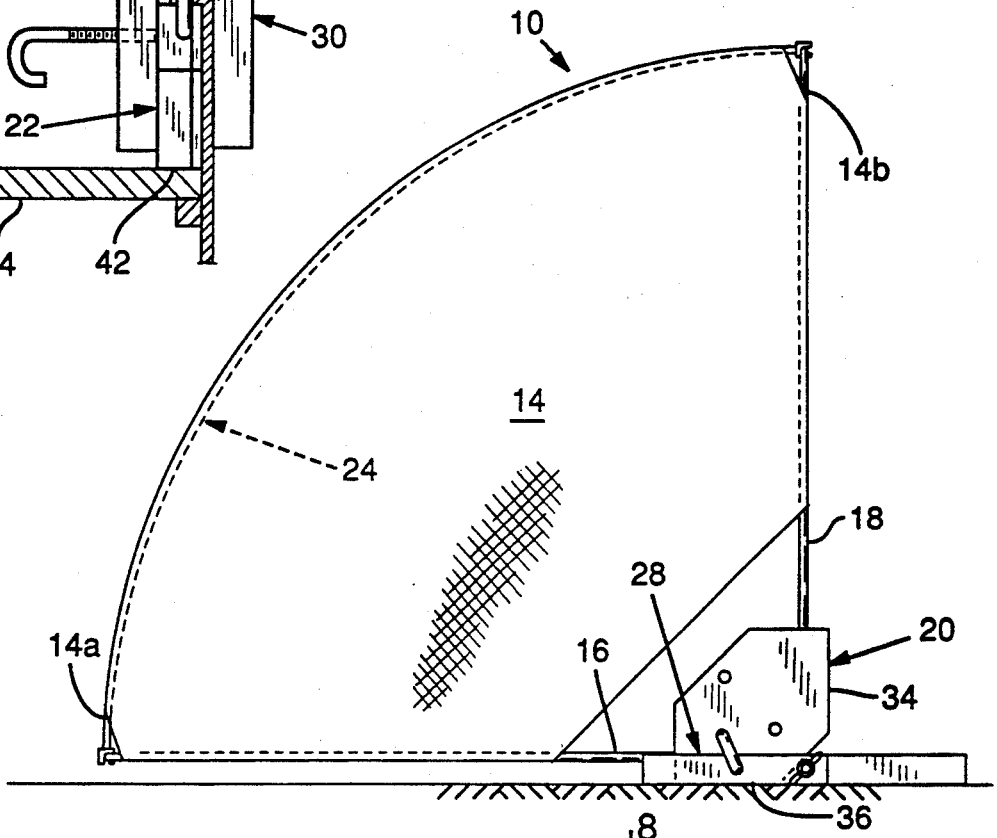
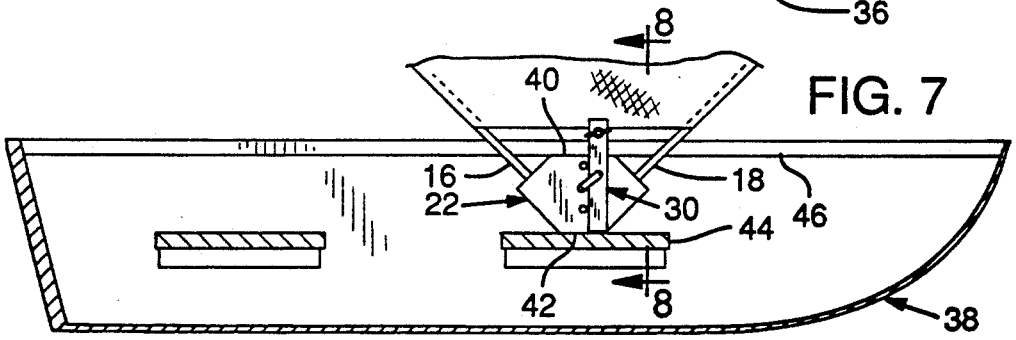
FIG. 7
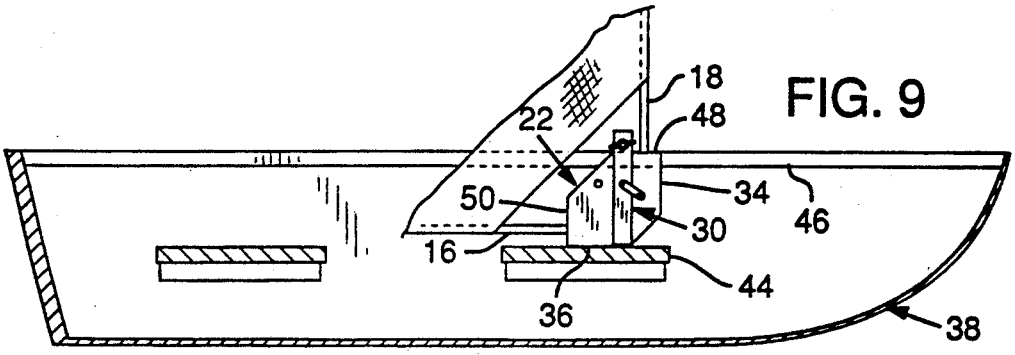
FIG. 9

WEATHER SHELTER

BACKGROUND OF THE INVENTION

1. Field of the Invention

The present invention relates generally to weather shelters and more particularly to a weather shelter adapted for association with a reference structure in any one of a plurality of relative orientations.

2. Description of the Prior Art

There are currently a variety of weather shelters available which exist for the express purpose of insulating an individual from specific weather conditions. Such shelters are commonly designed for fixed attachment to a particular reference structure, generally being securable to such structure in only one relative orientation. While such an arrangement may provide shelter under certain limited circumstances, it does not provide complete protection from the elements which are dynamic by nature. Weather conditions, for example, deviate significantly in approach, character and intensity. Known shelters have failed to address the need for shelters which compensate for these deviations. It is therefore an object of this invention to provide an improved weather shelter adapted to provide shelter under varied weather conditions.

The above-described shortcoming of known weather shelters is particularly apparent where shelters are used to protect an occupant from sunlight over a period of time. During the course of the day, for example, the sun passes across the sky, beating down from an ever-changing perspective. In order to provide continuous shade to an occupant, the shelter must thus be adaptable to maintain a position between the shelter occupant and the sun. A stationary shelter of the type now known would therefore. require a screen which spans an area matching the 180 degree relative path of the sun if it were desired to provide protection throughout the day. Such a shelter would unnecessarily restrict the occupant's freedom and would consequently be undesirable.

Wind, like sunlight, may change its direction of approach during the course of the day. Consequently, where it is desired to protect an occupant from the wind throughout the day, it is desirable to use a weather shelter adapted to obstruct the path of the wind irrespective of its direction of approach. Prior art weather shelters have failed to provide adequate wind protection, such shelters generally being fixed in one relative orientation to a reference structure with which they are associated.

It is also important to note that although the sun generally beats down on an individual, the wind sweeps past. Protection from these elements may consequently require placement of a shelter in vastly varying relative orientations with respect to the reference structure. It is, therefore, an object of this invention to provide a weather shelter which may selectively be positioned in one of a plurality of orientations relative to the reference structure.

SUMMARY OF THE INVENTION

The present invention concerns a shelter which provides an occupant or occupants with protection from the elements under various weather conditions. The invention may be used in a variety of orientations relative to a reference structure, the available protection depending upon such orientation. The shelter includes a framework, a flexible cover attached to the framework, and at least one anchor assembly for uniting the framework and the reference structure.

The framework provides support for the cover, including a plurality of spaced bows, each terminating oppositely in first and second terminal ends. The flexible cover is attached to the framework, spanning a substantial portion of the space between the bows to provide shelter for the occupant. The anchor assembly is adapted for attachment to the framework to unit the framework and the reference structure in one of a plurality of relative orientations.

As a consequence of these features, this invention uniquely offers its occupant a high degree of flexibility, the shelter being usable under a variety of weather conditions. The shelter may be attached to virtually any reference structure, either resting on the structure or being secured thereto using the anchor assembly.

As the reader continues with a study of the drawing figures and the detailed description which focuses attention on the present invention, other important features, offerings and advantages will become apparent.

BRIEF DESCRIPTION OF THE DRAWINGS

FIG. 1 is a perspective view illustrating a preferred embodiment of the invented shelter, the shelter being orientated in a full tent disposition and having its cover partially broken away to substantially expose the shelter's skeletal framework.

FIG. 2 is an enlarged fragmentary perspective view generally embracing the area captured by arrows 2—2 in FIG. 1.

FIG. 3 is an exploded perspective view illustrating one of the interface members of the shelter depicted in FIG. 1.

FIG. 4 is a sectional view of the shelter depicted in FIG. 1, the view being taken generally along line 4—4 therein to illustrate one of the shelter's anchor assemblies.

FIG. 5 is a perspective view of an anchor assembly embodiment including stake mechanism for use in securing the anchor assembly to the ground.

FIG. 6 is a side view of the shelter embodiment of FIG. 1, the shelter being oriented in a half-tent disposition.

FIG. 7 is a fragmentary elevational view of the shelter depicted in FIG. 1, the shelter being secured to the side of a boat in a full tent disposition.

FIG. 8 is a fragmentary elevational view of the shelter of FIG. 7, the view being taken generally along line 8—8 therein.

FIG. 9 is a fragmentary elevational view of the shelter depicted in FIG. 1, the shelter being secured to the side of a boat in a half tent disposition.

DESCRIPTION OF THE PREFERRED EMBODIMENT

The present invention relates to a shelter of the type used to protect an occupant or occupants from unwanted exposure to the elements. The shelter is adaptable for use in protecting individuals from a variety of weather conditions and may be used in association with virtually any reference structure.

Referring initially to FIG. 1, the reader is provided with an illustration of the preferred embodiment of the invented shelter, the shelter being indicated generally at 10. As indicated, the proposed shelter includes a skeletal framework 12, such framework being adapted to provide support for a flexible cover 14. Flexible cover 14 is partially broken away in FIG. 1 to allow for more complete illustration of the shelter's framework, a description of which will now be given.

In accordance with my teachings, framework 12 thus includes a pair of elongate bows 16, 18, each bow terminating oppositely in first and second terminal ends. The bows are generally U-shaped, preferably being permanently pre-curved to simplify assembly of the invented shelter as will be described below. Bows 16 and 18 are also preferably resilient, providing a framework which is deformable within predetermined limits. Toward these ends, and in the interest of providing a portable shelter, bows 16 and 18 are formed of a suitable light weight material such as ¼-inch aluminum bar. Such aluminum bar has proven to be light weight, permanently bendable and resiliently deformable within a desired range of applied force.

In keeping with the desired portable nature of the shelter, bows 16 and 18 are also collapsible, each including a pair of removably joined sub-bows such as those shown at 16*a* and 16*b* in FIG. 2. As indicated, the sub-bows are joined via structure such as a ferule 16*c*. In the preferred embodiment, each sub-bow is approximately 5½ feet long, providing a shelter suitable for occupancy by individuals of average height as will be understood upon reading further.

Focusing attention more broadly on the framework structure depicted in FIG. 1, it will be noted that bows 16 and 18 are operatively combined adjacent their corresponding terminal ends via interface members 20 and 22. The interface members aid in maintaining the positional relationship between the bows, such bows extending in substantially perpendicular directions to define a space therebetween. As will be appreciated, each interface member is suitable for operative combination with either the first terminal ends or the second terminal ends of the bows in a manner described below.

In the preferred embodiment, the interface members are made of a water-buoyant material such as wood, providing the structure with water buoyancy as a whole. This feature has proven particularly valuable when the invented shelter is used on structure such as a boat, or in proximity to the body of water, the risk of shelter loss being substantially diminished.

Focusing now specifically on the interface members, the reader's attention is directed to FIG. 3, an enlarged and exploded view of interface member 20 being depicted therein. Interface member 22 is substantially identical to interface member 20 and thus need not be separately described.

As shown, member 20 is preferably a two-component structure, the member including a core portion 20*a* and a plate portion 20*b*. The two components are substantially identically shaped, collectively defining a plurality of planar edges on which the framework may rest as will be described below. In addition, interface member 20 may define one or more holes such as those indicated at 52. The reader will note that the holes in the core and plate portions align to provide holes which pass completely through member 20. The shelter may thus be tied to a reference structure using ropes or ties which pass through the holes.

Referring still to FIG. 3, it will be observed that core 20*a* defines a pair of elongate grooves $20a_1$, $20a_2$. Preferably, the grooves are set at an angle of approximately 100 degrees to one another and each groove communicates with an exterior edge of the core. The grooves are of a width and depth sufficient to accommodate receipt of one of the previously described bows therein.

As indicated, the core and plate are suitable for combination to form a single interface member, such combination effectively forming a pair of slots adapted for removable receipt of the terminal ends of the bows. In the preferred embodiment, the slots formed have a depth which makes it difficult to remove the bows when the shelter is in use. Those skilled in the art will recognize that the core and plate may be secured together using any suitable means, but in the preferred embodiment are fastened using screws.

As shown in FIG. 1, framework 12 includes a spine 24, such spine extending across a space between bows 16 and 18. Like the previously described bows, spine 24 is generally arcuate and is preferably made of a light weight resilient material such as aluminum. The spine is approximately 6 feet in length, including a pair of elongate, curved segments 24*a* and 24*b*. Segments 24*a* and 24*b* are connected to one another via a ferule joint 24*c*. The spine thus breaks down into two smaller segments complementing the portability feature of the shelter. Those skilled in the art will recognize that although, in the preferred embodiment of the invention, ferule joints have been chosen to connect the spine segments together and to connect the sub-bows together, any suitable connection means may be used.

Returning to a discussion of FIG. 2, an enlarged-scale perspective view of area 2—2 in FIG. 1 is provided, such perspective illustrating the preferred manner in which spine 24 is attached to bow 16. The opposite end of the spine is attached to bow 18 in a similar manner. As shown, the end of spine 24 is fitted with a footing 26, such footing taking the form of an elongated block. Footing 26 defines a groove 26*a* adapted for purchase of an expanse of bow 16. Upon flexing of the bows or the spine, the bow may be removed from the groove and thereby from association with the spine. The spine segments may then be disconnected and the framework disassembled.

Turning now to a discussion of flexible cover 14, and referring principally to FIGS. 1, 2 and 6, it will be seen that the cover and framework collectively define a parabolic cavity in which occupants may obtain shelter. Toward this end, the cover is attached to the framework, providing a shelter which will stand up to the elements. Cover 14 thus defines a number of sleeves similar to that shown at 14*a* in FIG. 2. As indicated, sleeve 14*a* is adapted for receipt of bow 16 to maintain the relationship between the framework and the cover. Although not shown, sleeves may also be provided for receipt of bow 18 and spine 24, further aiding in maintaining the relationship between the cover and the framework. The cover may also define an opening in the region where each bow intersects with the spine, allowing for attachment of the spine to the bows without obstruction.

In the preferred embodiment, cover 14 is made from a material which allows passage of a limited amount of light or wind without substantially hindering the visibility of the occupant. The cover, for example, may be composed of SUNSCREEN®, a material manufactured by Phifer Wire Products, Inc. of Tuscaloosa, Ala. Such material has been proven to restrict heat as well as wind and light. Where it is also desired to protect the occupant from rain, a water impermeable sheet may be placed over the cover and clipped to the framework by suitable fastening means.

Shelter 10 also includes a pair of substantially identical anchor assemblies 28, 30, such anchor assemblies being selectively securable to the framework to provide for the unification of the shelter and a reference structure in one of a plurality of relative orientations. As will be explained, each anchor assembly is securable to the framework at any one of a plurality of securement locations, such locations, in the preferred embodiment, being defined at positions on the surface of the interface members.

As shown in FIG. 4, anchor assembly 28 includes a pair of elongate pivot arms 28*a* and 28*b*, such arms being operatively pivotally connected to one another adjacent a central axis of relative pivot A. In the preferred embodiment, axis A is defined by a pin such as bolt 28*c* which extends through the arms adjacent corresponding pivot ends $28a_1$ and $28b_1$. Bolt 28*c* allows for relative pivot action of said arms about axis A. In order to provide for the clamping of the shelter to the reference structure, pivot arms 28*a* and 28*b* are parallelly movable toward and away from one another while maintaining their parallel relative relationship by tightening of a wing nut $28c_1$.

Referring still to FIG. 4, it will be noted that a keeper 28*d* extends through arm 28*a* to aid in securing the anchor assembly to the interface member. The keeper is essentially a projection which abuts the interface member pushing the same against the opposite arm of the anchor assembly. The keeper abuts the interface member at any one of a plurality of securement locations to provide for multi-positional combination of the anchor assembly and the framework. The securement locations are points at which the keeper engages the interface member, one such securement location being shown at 20*c* in FIG. 4.

As shown in FIG. 5, anchor assembly 28 may be fitted with a removable stake mechanism 32, such stake mechanism being usable to secure the shelter to a reference structure such as the ground. Stake mechanism 32 includes a pair of downwardly extending spikes 32*a*, 32*b*, and a hold down bar 32*c*. The hold down bar is adapted for extension through holes in the spikes to define a U-shaped stake mechanism. As shown, the U-shaped stake mechanism is capable of straddling the anchor assembly, the spikes being driven into the ground to secure the shelter thereto.

Having described the particular components of the inverted shelter, a description is now provided of the preferred mode of operation, such operation being characterized by the shelter's suitability for association with reference structures in a variety of relative orientations. Referring first to FIG. 1, the reader will observe that the shelter is suitably configured for placement on a horizontal surface in what will hereinafter be explained as constituting a full tent diposition. The shelter may, in this configuration, rest on virtually any substantially horizontal surface including structures such as a dock, a pier, or even the ground.

Upon continued reference to FIG. 1, the reader will note that shelter 10 is configured such that it may be supported on a support base defined by anchor assemblies 28 and 30. As shown, each anchor assembly is arranged such that its pivot arms extend substantially oppositely from the pivot axis. The anchor assemblies thus define a pair of Z-shaped foundations. (See FIG. 4). Such foundations, in combination, provide for free-standing placement of the shelter on the reference structure.

As noted, the shelter is adapted for placement in multiple orientations relative to the plane of the reference structure. The full tent disposition, having previously been identified as that shown in FIG. 1, is characterized by attachment of the anchor assemblies to the framework in a manner which provides for placement of the shelter in a position wherein the forward-to-aft arc of its cover is centered above an imaginary line extending through both interface members. Such orientation is particularly useful in protecting the occupant from undesirable weather conditions which approach the occupant from directly above such as sunlight or rain.

As shown in FIG. 6, shelter 10 may alternatively be arranged in what is referred to herein as a half tent disposition. When oriented in a half tent disposition, the shelter rests on the reference structure in a manner wherein one of the bows defines a plane adjacent to a horizontal surface of a reference structure on which the shelter is placed. To achieve such an orientation relative to the plane of the reference structure, the anchor assembly is secured to the framework in a matter such that the arms extend in directions substantially parallel to either edge 34 or edge 36 of interface member 20. Such relative orientation is particularly suited for use in protecting an occupant from wind.

Those skilled in the art will recognize that although both FIGS. 1 and 6 show weather shelters wherein the anchor assemblies are arranged to provide a Z-shaped foundation, it is possible to arrange the anchor assemblies in a manner similar to that shown in FIG. 5. In such an arrangement, a corresponding interface member is clamped between the pivot arms and the stake mechanism is used to secure the shelter to the ground. An arrangement such as this provides particular advantages where strong winds present a problem.

In FIGS. 7 and 8, the invented weather shelter is shown attached to the side of a boat 38 in a full tent disposition. As indicated in FIG. 7, each interface member is specifically adapted to include a pair of substantially planar opposite edges 40 and 42 such that interface member 22 fits between seat 44 and gunnel 46 of the boat, adding to the integrity of the structure. The shelter is clamped to the boat using anchor assemblies 28 and 30, only clamp 30 being illustrated in FIGS. 7 and 8. To provide for an improved frictional relationship between the boat and the shelter, the interface members may be characterized by rough surfaces.

The shelter may also be attached to the boat in a half-tent disposition, such an arrangement being shown in FIG. 9. Where desired, the interface members may be sized such that oppositely facing planar surfaces 36 and 48 fit between seat 44 and gunnel 46 of boat 38. The interface members may similarly be sized such that oppositely facing planar surfaces 34 and 50 fit between the seat and gunnel of the boat when the orientation of the shelter is to be rotated 90 degrees clockwise from the orientation shown in FIG. 9. The shelter is clamped to the boat in a manner similar to that depicted in FIGS. 7 and 8.

Although not shown, those skilled in the art will recognize that the invented weather shelter may be secured to alternative reference structures including lawn chairs or the like. Where it is desirous for the shelter to be secured to lawn chairs, the interface members may either be clamped to the chairs in a manner similar to that shown in FIGS. 7–9 or the shelter may be tied to the chairs using a rope or tie which passes through holes in the interface members.

Although a preferred embodiment of the invention has been disclosed, it should be appreciated that variations and modifications may be made without departing from the scope of the invention as defined by the claims.

What I claim is:

1. A weather shelter adapted for multi-positional placement adjacent a reference structure, said shelter comprising:

a framework including an interface member and a plurality of spaced bows, each bow having first and second terminal ends with said interface member operatively joining a corresponding pair of said terminal ends;

a flexible cover attached to said framework and spanning a substantial portion of said space between said bows; and an anchor assembly selectively securable to said interface member in different, selected relative orientations, said anchor assembly being operable to secure said framework to the reference structure.

2. The weather shelter of claim 1, wherein said anchor assembly includes a keeper for selective securement to any one of an infinite plurality of securement locations on said interface member.

3. The weather shelter of claim 1, wherein said anchor assembly includes a pair of relatively adjustable, elongate arms.

4. The weather shelter of claim 3, wherein said elongate arms are adapted for clamping said framework to the reference structure.

5. The weather shelter of claim 3, wherein said anchor assembly further includes a stake mechanism for selectively securing at least one of said arms to the reference structure.

6. The weather shelter of claim 5, wherein said stake mechanism has a pair of elongate spikes separated by a hold down bar to provide for straddling of at least one of said arms by said stake mechanism.

7. A weather shelter adpated for multi-positional placement adjacent a reference structure, said shelter comprising:

a pair of spaced bows, each having first and second terminal ends;

a flexible cover attached to said bows and spanning a substantial portion of said space therebetween;

a pair of interface members, each defining an infinite plurality of securement locations, one of said interface members operatively joining said bows adjacent said first terminal ends and maintaining said first terminal ends in fixed relative adjacency, and the other of said interface members operatively joining said bows adjacent said second terminal ends and maintaining said second terminal ends in fixed relative adjacency; and a pair of anchor assemblies, each selectively securable to one of said interface members in different, selected relative orientations via a pair of relatively adjustable elongate arms, a keeper being operatively secured to one of said arms and engaging one of said securement locations for maintaining the selected orientation between said anchor assembly and said interface member, said anchor assemblies being effective in uniting said weather shelter and the reference structure in a plurality of different relative orientations.

8. The weather shelter of claim 7, wherein each arm of each arm pair includes a pivot end, corresponding arms being operatively pivotally connected to one another adjacent said pivot ends.

9. The weather shelter of claim 8, wherein corresponding arms are relatively pivotable to extend selectively in opposite directions, providing a foundation for free-standing placement of said shelter.

10. The weather shelter of claim 9, wherein each arm pair selectively defines a Z-shaped foundation having a substantially central axis of relative pivot between corresponding arms.

11. The weather shelter of claim 7, wherein said arms of each arm pair are selectively arranged in spaced parallelism, said arms being parallelly movable toward and away from one another to collectively provide clamp mechanism for clamping said shelter to the reference structure.

12. The weather shelter of claim 7, wherein said flexible cover includes sleeves through which said bows extend.

13. The weather shelter of claim 7, wherein said framework further includes an elongate spine adapted for transverse extension between said bows.

14. The weather shelter of claim 13, wherein said spine includes plural, elongate elements operatively detachably coupled to one another.

15. The weather shelter of claim 14, wherein said spine terminates oppositely in a pair of footings, each footing being adapted for removable operative association with one of said bows.

16. The weather shelter of claim 7, wherein each of said interface members includes a core having plural elongate grooves and a plate secured to said core to define slots for receipt of said bows.

17. The weather shelter of claim 7, wherein at least a portion of said shelter is composed of a water-buoyant material, providing said shelter with water-buoyancy as a whole.

18. A weather shelter adapted for multi-positional placement adjacent a reference structure, said shelter comprising:

a pair of spaced bows, each having first and second terminal ends;

a flexible cover having sleeves through which said bows extend, said flexible cover spanning a substantial portion of said space between said bows;

a pair of interface members, each defining an infinite plurality of securement locations, one of said interface members operatively joining said bows adjacent said first terminal ends and maintaining said first ends in fixed relative adjacency, and the other of said interface members operatively joining said bows adjacent said second terminal ends and maintaining said second ends in fixed relative adjacency; and a pair of anchor assemblies, each selectively securable to one of said interface members in different, selected relative orientations via a pair of elongate arms operatively associated with one another adjacent corresponding pivot ends in selectively spaced parallelism to allow selected clamping of said framework to the reference structure, said arms being relatively pivotable about a pivot axis intersecting said arms adjacent said corresponding pivot ends between an arrangement wherein said arms extend unidirectionally from said pivot axis for clamping of said framework to the reference structure and an arrangement wherein said arms extend oppositely from said pivot axis for defining a foundation for freestanding placement of said framework on the reference structure, each anchor assemblies further including a keeper operatively secured to one of said arms and having a projection which selectively engages one of said securement locations.

* * * * *